US005924250A

United States Patent [19]

Jungwirth et al.

[11] Patent Number: 5,924,250

[45] Date of Patent: Jul. 20, 1999

[54] SEALING ARRANGEMENT IN A BUNDLED TENSION MEMBER FOR PRESTRESSED CONCRETE

[75] Inventors: Dieter Jungwirth, Bad Heilbrunn; Oswald Nützel, Munich, both of Germany

[73] Assignee: Dyckerhoff & Widmann Aktiengesellschaft, Munich, Germany

[21] Appl. No.: 08/907,833

[22] Filed: Aug. 14, 1997

[30] Foreign Application Priority Data

Aug. 28, 1996 [DE] Germany ..... 196 34 682

[51] Int. Cl.[6] ..... E04C 3/10

[52] U.S. Cl. ..... 52/223.9; 52/223.1; 52/223.11; 52/223.14; 52/231; 428/378; 428/375; 428/383; 428/374; 138/158; 138/163; 138/168; 14/23

[58] Field of Search ..... 52/223.1, 223.8, 52/223.9, 223.11, 223.14, 231; 14/22, 23; 428/378, 375, 373, 374, 383; 138/158, 163, 168, 175, 176

[56] References Cited

U.S. PATENT DOCUMENTS 4,612,680 9/1986 Daiguji ..... 14/22
4,718,965 1/1988 Finsterwalder et al. ..... 156/294
4,848,052 7/1989 Nutzel ..... 52/230
4,878,327 11/1989 Nutzel et al. ..... 52/230
5,173,982 12/1992 Lovett et al. ..... 14/22
5,573,852 11/1996 Thal ..... 428/378

FOREIGN PATENT DOCUMENTS 4433847 3/1996 Germany .

*Primary Examiner*—Christopher Kent
*Assistant Examiner*—Yvonne Horton-Richardson
*Attorney, Agent, or Firm*—Friedrich Kueffner

[57] ABSTRACT

A sealing arrangement for closing off the areas to be filled with a casting compound of a tension member composed of a bundle of individual elements arranged within a tubular sheathing, for example, a stay cable of a cable-stayed bridge, includes a sealing plug composed of a first sealing layer of a deformable, non-flowable sealing material introduced between the individual elements, a second sealing layer of a setting or hardenable material introduced in a flowable state and arranged adjacent the first sealing layer in the direction toward the area to be filled out with casting compound.

21 Claims, 3 Drawing Sheets

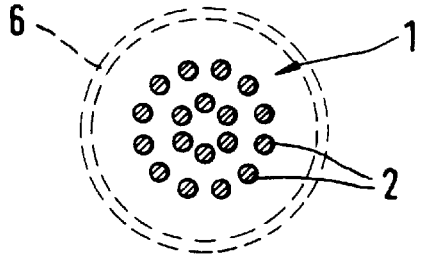
Fig.1
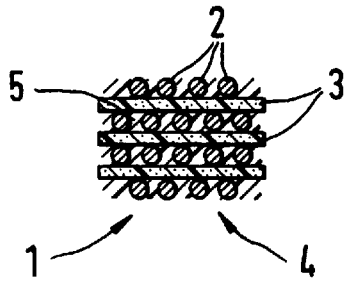
Fig.2
Fig.3
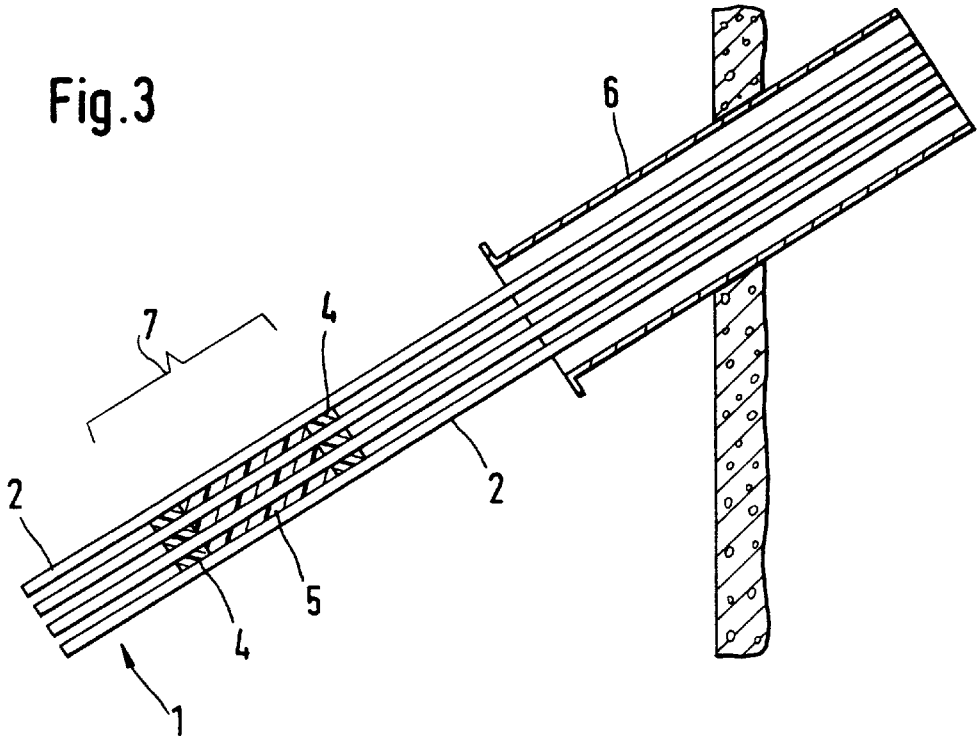

SEALING ARRANGEMENT IN A BUNDLED TENSION MEMBER FOR PRESTRESSED CONCRETE

BACKGROUND OF THE INVENTION

1. Field of the Invention

The present invention relates to a sealing arrangement for limiting or closing off the areas to be filled with a casting compound of a tension member composed of a bundle of individual elements arranged within a tubular sheathing, for example, a stay cable of a cable-stayed bridge.

The present invention also relates to a method of manufacturing the arrangement.

2. Description of the Related Art

In tension members as they are used in civil engineering, for example, tension members for prestressed concrete, stay cables for cable-stay bridges, or the like, usually several individual elements, such as, steel rods, steel wires or strands are combined into a bundle and are arranged within a tubular sheathing to protect the bundle against corrosion. In the area of the free length of the tension member, this tubular sheathing usually is composed of a sheathing tube of synthetic material, for example, polyethylene, and in the anchoring area, where the individual elements are spread apart for anchoring, the sheathing is composed of a steel pipe which expands or widens in a trumpet-shaped configuration.

In such tension members it is frequently necessary, for technical or economical reasons, to fill out certain areas along the length of the tension member, for example, the area of an anchoring system or a guide saddle, with a setting material, for ,example, cement mortar, synthetic resin mortar or synthetic resin, in order to obtain a bonding action or for placing the individual elements in the correct order or for supporting the individual elements against deflection forces, while the remaining areas, particularly the free length of the tension member, are not filled out in this manner, among other reasons, to reduce the weight. In order to limit or seal off these areas from each other and in order to prevent an unintentional flowing out of the filling material when it is injected, it is necessary to provide sealing arrangements. Such sealing arrangements are particularly necessary in stay cables of cable-stayed bridges at the upper anchoring system on the tower of the cable-stayed bridge, as disclosed in German Patent application 44 33 847 A1.

Particularly in the case of bundled tension members having a large number of individual elements, it is difficult to construct the sealing arrangements of the above-described type. These sealing arrangements not only must tightly surround each individual element, but they must also fully fill out the remaining annular space up to the inner wall surface of the sheathing, in order to ensure a reliable sealing action even with respect to injection materials which are present as thin liquids, particularly synthetic resin.

SUMMARY OF THE INVENTION

Therefore, it is the primary object of the present invention to provide a sealing arrangement of the above-described type in bundled tension members which ensures in an economical manner a reliable sealing of the hollow space within the sheathing tube and between the individual elements even against injection materials which are present as thin liquids.

In accordance with the present invention, the sealing arrangement includes a sealing plug composed of a first sealing layer of a deformable, non-flowable sealing material introduced between the individual elements, a second sealing layer of a setting or hardenable material introduced in a flowable state and arranged adjacent the first sealing layer in the direction toward the area to be filled out with casting compound.

The method according to the present invention for manufacturing the sealing arrangement includes the steps of initially filling out the hollow spaces between the individual elements with a deformable, non-flowable sealing material before the sheathing tube is mounted for forming a first sealing layer, and subsequently, after at least primarily mounting the sheathing tube, a flowable setting material is injected for forming the second sealing layer.

Accordingly, the basic concept of the present invention is to construct such a sealing arrangement layer by layer in successive steps from different materials having different properties in the manner of a filter, wherein the filter effect ranges from closing large pores to closing fine pores.

Thus, a first sealing layer of a "finished" sealing material which is deformable but not flowable, such as silicone, is provided at an accessible area still outside of the sheathing tube during the assembly of the tension member, wherein an additional sealing barrier of transversely extending strips of a compressible material, such as foam material, particularly expanding foam material, may be added on one or on both sides. Any points of leakage still remaining in the first sealing layer are closed by a sealing liquid, preferably cement mortar, which is introduced after the sheathing tube has been at least preliminarily mounted as a formwork. The sealing plug produced in this manner also serves the purpose of absorbing the weight of the final filling material in the anchoring area.

If an even more thorough sealing of even the finest pores is required, for example, when the anchoring area is to be filled out with liquid synthetic resin, an additional sealing layer of a liquid synthetic resin may be placed on the sealing plug, wherein this additional sealing layer closes in a pressureless manner even the finest leakage points.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a cross-sectional view of a prestressing steel bundle showing individual elements thereof in a radial arrangement;

FIG. 2 is a cross-sectional view of the prestressing steel bundle arranged in layers for manufacturing the first layer of the sealing arrangement; and FIGS. 3–6 are schematic longitudinal sectional views of a stay cable in the area of an upper anchoring system on a tower, showing successive method steps in manufacturing the sealing arrangement according to the present invention.

DESCRIPTION OF THE PREFERRED EMBODIMENTS

Figure 4:
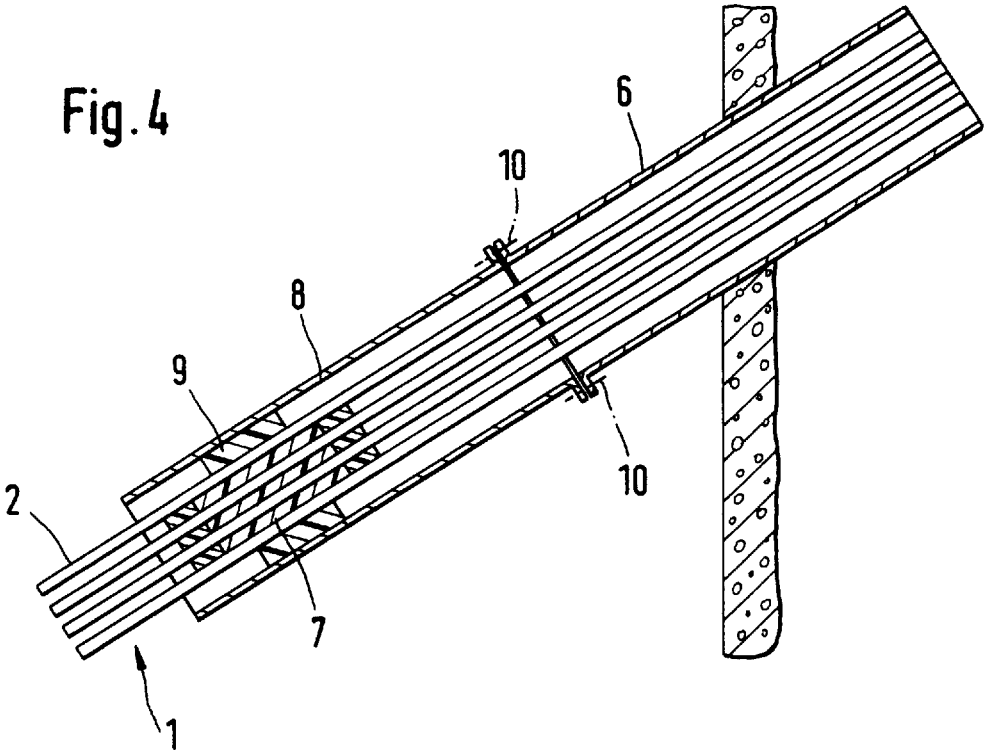

In tension members of the above-described type, such as stay cables for cable-stayed bridges, the individual elements 1 of a prestressing steel bundle 1 usually are arranged radially as illustrated in FIG. 1. The individual elements 2 are anchored in this radial arrangement at the ends of the respective tension member by means of anchoring disks in anchoring devices, wherein the anchoring disks are provided with bores having the same radial arrangement as the individual elements, so that the individual elements 2 can extend through the bores and be provided with wedges, nuts or the like. As shown in FIG. 1 in broken lines, to protect the prestressing steel bundle 1 against corrosion, the bundle 1 is guided within a tubular sheathing 6 composed of a steel tube or a plastic tube.

For manufacturing the sealing arrangement according to the present invention, when the stay cable is assembled, the individual elements 2 are arranged in an area outside of the sheathing 6 accessible for such operations in such a way that the first sealing layer can be mounted in layers between the individual elements. FIG. 2 of the drawing shows how the individual elements are arranged in layers. Initially, at two locations of the prestressing steel bundle 1 located at a short distance from each other, for example 10 cm, transversely extending strip-shaped elements 3 of a compressible material, for example, expandable foam material, are inserted between the individual elements 2 in this manner advantageously progressively from the bottom toward the top, so that first sealing barriers 4 and simultaneously lateral limitations for the first sealing layer are produced, as can be seen in FIG. 3.

A deformable, non-flowable sealing material 5 is now introduced between the sealing barriers 4 into the intermediate spaces between the individual elements 2 which are arranged in layers. This sealing material 5, which may be composed of an elastically setting silicone, but also of rubber pieces, polyurethane foam, etc., has the purpose of coarsely sealing the hollow space and to prevent a hardenable material to be introduced subsequently in flowable form from flowing out. This is also advantageously effected layer by layer when introducing the strip-shaped elements 3 from the bottom toward the top. These operations result in the formation of a first sealing layer, which is denoted by reference numeral 7 in FIG. 3.

Because of the fact that the sealing materials of the first sealing layer 7 are deformable, the individual elements 2 can at least approximately assume their radial configuration once again after the above-described manipulations have been carried out.

In order to also seal the annular space between the envelope of the individual elements 2 and the inner wall of the sheathing tube, indicated by reference numeral 8 in the area in which the seal is to be manufactured, in a next step a sealing material, for example, a winding 9 of a deformable, strip-shaped material, is arranged around the first sealing layer 7 before a sheathing tube 8, for example, in the form of half shells, is mounted from the outside and is connected through flanges and screws 10 to the pipe 6 of the anchoring area. This sheathing tube 8 is required as formwork for introducing the setting material forming the additional sealing layers; the sheathing tube 8 may be permanent or temporary and, after the introduced material has hardened, can be removed again for later mounting the final sheathing tube, as illustrated in FIG. 4.

Figure 5:
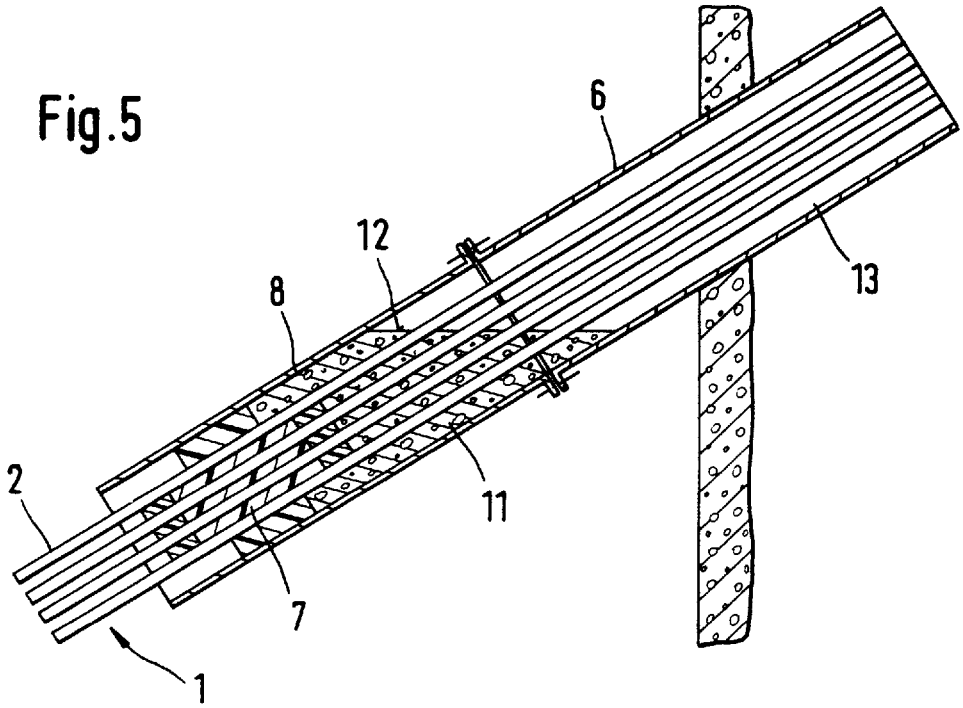

As illustrated in FIG. 5, by means of a suitably arranged line, for example, a lance introduced from the anchoring side, a setting material, for example, cement mortar, is introduced into the hollow space formed by the sheathing tube 8 and above the first sealing layer 7, wherein the setting material forms a level 12 within the sheathing tubes 8 or 6. Thus, the setting material forms a second sealing layer 11. To protect this material against the formation of cracks, a mesh wire may be wound around the prestressing steel bundle 1. This setting material introduced in liquid form closes any small leakage points which may have remained in the first sealing layer 7. The injection may be repeated if necessary, even using more viscous material. The sealing plug produced in this manner also has the purpose of absorbing the weight of any final filling material which may later be introduced into the hollow space 13 of the adjacent anchoring area.

Figure 6:
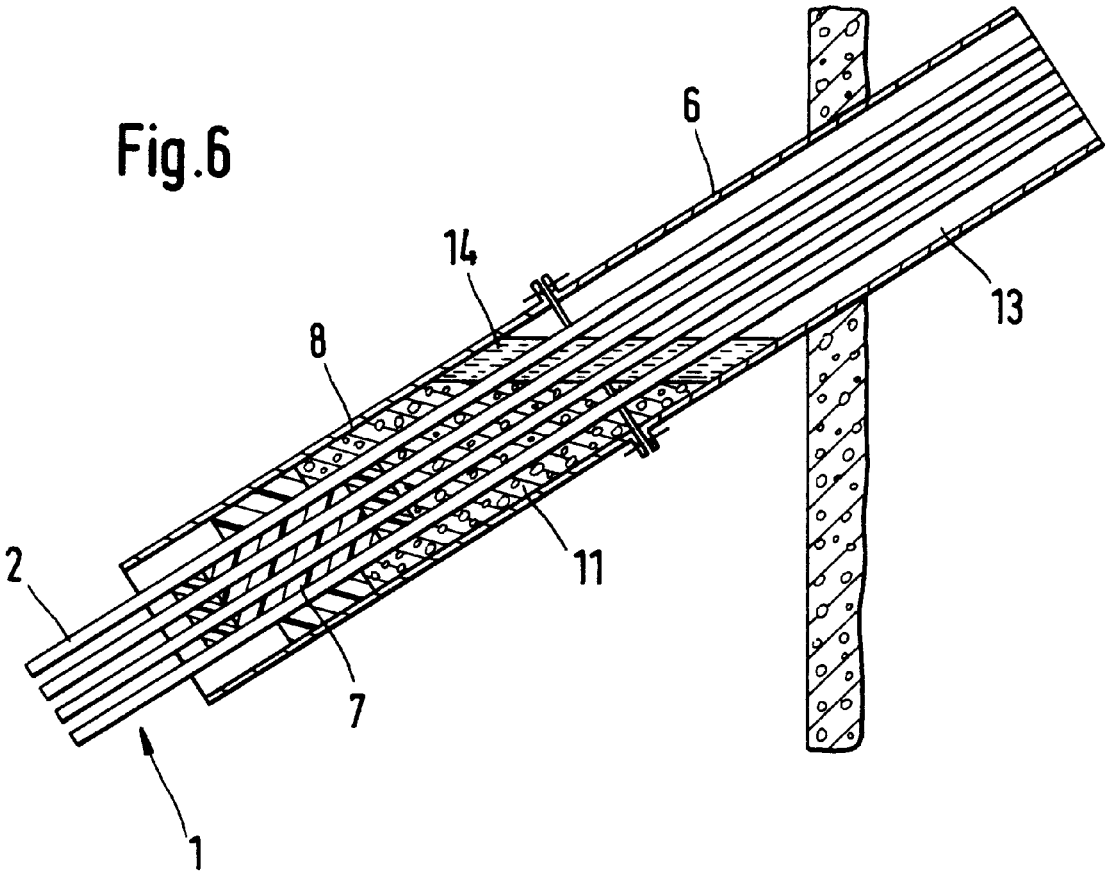

If the adjacent anchoring area 13 of the prestressing steel bundle 1 is filled with cement mortar, no additional measures are required. However, if the anchoring area 13 is to be filled out with liquid synthetic resin, it is advisable to provide an additional third sealing layer 14 of liquid synthetic resin which, as a result of its consistency, is capable of closing in a pressureless manner even the finest leakage points, as shown in FIG. 6. After this third layer has hardened, the final filling of synthetic resin can be introduced into the anchoring area.

While specific embodiments of the invention have been shown and described in detail to illustrate the inventive principles, it will be understood that the invention may be embodied otherwise without departing from such principles.

We claim:

1. A sealing arrangement for sealing off an area of a tension member composed of a bundle of individual elements arranged within a tubular sheathing, wherein the area is adapted to be filled out with a casting compound, the sealing arrangement comprising a first sealing layer of a deformable, non-flowable sealing material introduced between the individual elements, and a second sealing layer of a setting material introduced in flowable form at a location adjacent the first sealing layer in a direction toward the area adapted to be filled out with casting compound.

2. The sealing arrangement according to claim 1, wherein the non-flowable sealing material is silicone.

3. The sealing arrangement according to claim 1, wherein the setting material is cement mortar.

4. The sealing arrangement according to claim 1, comprising an additional sealing barrier comprised of strip-shaped elements of a compressible material inserted between the individual elements on at least one side of the first sealing layer.

5. The sealing arrangement according to claim 4, wherein the compressible material is foam material.

6. The sealing arrangement according to claim 5, wherein the foam material is expandable.

7. The sealing arrangement according to claim 1, comprising a reinforcement embedded in the second sealing layer of setting material.

8. The sealing arrangement according to claim 7, wherein the reinforcement is comprised of wire mesh or steel fibers.

9. The sealing arrangement according to claim 1, comprising a third sealing layer of a setting material introduced in liquid form at a location adjacent the second sealing layer in the direction toward the areas to be filled out with casting compound.

10. The sealing arrangement according to claim 9, wherein the material of the third sealing layer is synthetic resin.

11. A method of manufacturing a sealing arrangement for sealing off an area of a tension member to be filled with a casting compound, the tension member including a bundle of individual elements arranged within a tubular sheathing, the method comprising forming a first sealing layer prior to mounting the sheathing by filling hollow spaces between the individual elements with a deformable, non-flowable sealing material, and subsequently, after the sheathing has been mounted at least temporarily, forming a second sealing layer by injecting a flowable setting material at a location adjacent the first sealing layer toward the area to be filled out with casting compound.

12. The method according to claim 11, wherein the non-flowable sealing material is silicone.

13. The method according to claim 11, wherein the flowable setting material is cement mortar.

14. The method according to claim 11, comprising at least temporarily placing the individual elements in a layer by layer configuration for introducing the first sealing layer.

15. The method according to claim 11, comprising, prior to introducing the first sealing layer, inserting between the individual elements strip-shaped elements of a compressible material extending transversely of a longitudinal direction of the tension member.

16. The method according to claim 15, wherein the strip-shaped elements are of an expandable foam material.

17. The method according to claim 11, comprising, after forming the first sealing layer and prior to mounting the sheathing, winding a sealing strip-shaped material around the bundle of individual elements.

18. The method according to claim 17, the strip-shaped material is densoband.

19. The method according to claim 11, comprising mounting the sheathing at least temporarily in the form of half shells.

20. The method according to claim 11, comprising, after the material of the second sealing layer has hardened, injecting a liquid setting material to form a third sealing layer adjacent the second sealing layer.

21. The method according to claim 20, wherein the liquid setting material is synthetic resin.

* * * * *